United States Patent [19]

Bock

[11] 3,935,722

[45] Feb. 3, 1976

[54] ROLLER GUIDE

[75] Inventor: Nils-Erik Ragnar Bock, Smedjebacken, Sweden

[73] Assignee: Morgardshammar Aktiebolag, Smedjebacken, Sweden

[22] Filed: Dec. 19, 1974

[21] Appl. No.: 534,582

[30] Foreign Application Priority Data

Dec. 20, 1973 Sweden ..... 7317220

[52] U.S. Cl. ..... 72/250; 72/227; 72/428

[51] Int. Cl.[2] ..... B21B 39/16

[58] Field of Search ..... 72/250, 227, 428

[56] References Cited

UNITED STATES PATENTS

| | | | |
|---|---|---|---|
| 2,599,847 | 6/1952 | Kritscher | 72/428 X |
| 3,326,027 | 6/1967 | Washburn | 72/428 X |
| 3,640,109 | 2/1972 | Ashton et al. | 72/250 |

*Primary Examiner*—Milton S. Mehr

[57] ABSTRACT

A roller guide for guiding rod or wire stock between a pair of rolls which shape the stock. The roller guide includes a pair of guide rollers which are adapted to engage the opposite surface portions of the stock and are mounted for rotation on a guide housing for rotation about substantially parallel axes. The guide housing is mounted upon a base. Fine adjustment means is included for effecting a fine adjustment of the position of the guide housing relative to the base in order to effect fine adjustment of the guide rollers. The fine adjustment means includes a member which is fixedly supported by the guide housing, a movable adjustment member and resilient means interposed between the member fixed on the guide housing and the movable adjustment member, which yields to enable movement of the guide housing and of both of the rollers to occur in response to forces applied to the rollers.

9 Claims, 3 Drawing Figures

ROLLER GUIDE

BACKGROUND OF THE INVENTION

The present invention relates to the rolling of rod or wire stock, and particularly to a roller guide for guiding the rod or wire stock between a pair of rolls which shape the stock. More particularly, the present invention is particularly directed to the fine adjustment of the roller guide.

In known rolling mills it has been customary that the final fine adjustment of the guide rollers has been a rigid adjustment so as to lock the guide rollers in their final position. With such form of rigid final adjustment, if the orientation of the rolling stock which enters the roller guide should be temporarily bent to one side or another, only one of the rollers will be principally loaded by the stock until the bent portion clears the roller guide. While it has been customary to load the rollers individually by spring mountings, it still remains that if only one roller in the pair of rollers is loaded, the other roller will not participate in the springing action and will therefore not be effective to guide the stock. Consequently, during these periods, a roller guide with one one roller loaded will not hold the stock as designed by the original final adjusted position of the roller guide.

In addition, in known roller guides having a substantially rigid final adjustment the type of loading caused by irregularly shaped stock has been found to introduce certain additional problems into the system. For example, with rigid final adjustment of the guide rollers there is potential for backlash within the system and of freezing up of the slide and screw adjustment means because of corrosion.

BRIEF DESCRIPTION OF THE INVENTION

According to the present invention, a roller guide is provided with a pair of rolls rotatably supported by a guide housing which in turn is itself mounted upon a base. The base is movable relative to the path of stock travel for effecting a course adjustment and fine adjustment means are provided to effect fine adjustment of the position of the guide housing relative to the base in order to effect the fine adjustment of the guide rollers. The fine adjustment means includes a member fixedly carried by the guide housing, a movable adjustment member and resilient means which are interposed between the movable adjustment member and the member and which yield to enable movement of the guide housing and both of the rollers to occur in response to forces applied to the rollers. In addition, the resilient means are effective to prestress the movable adjustment member and thereby reduce the likelihood of backlash within the system. Thus, the present invention provides a roller guide in which both rollers are adapted to respond to a condition of the rod stock which might tend to unevenly load the rollers.

Other objects and advantages of the present invention will be further apparent from the following specification and the accompanying drawings wherein:

DETAILED DESCRIPTION OF AN EMBODIMENT OF THE PRESENT INVENTION

Figure 1:
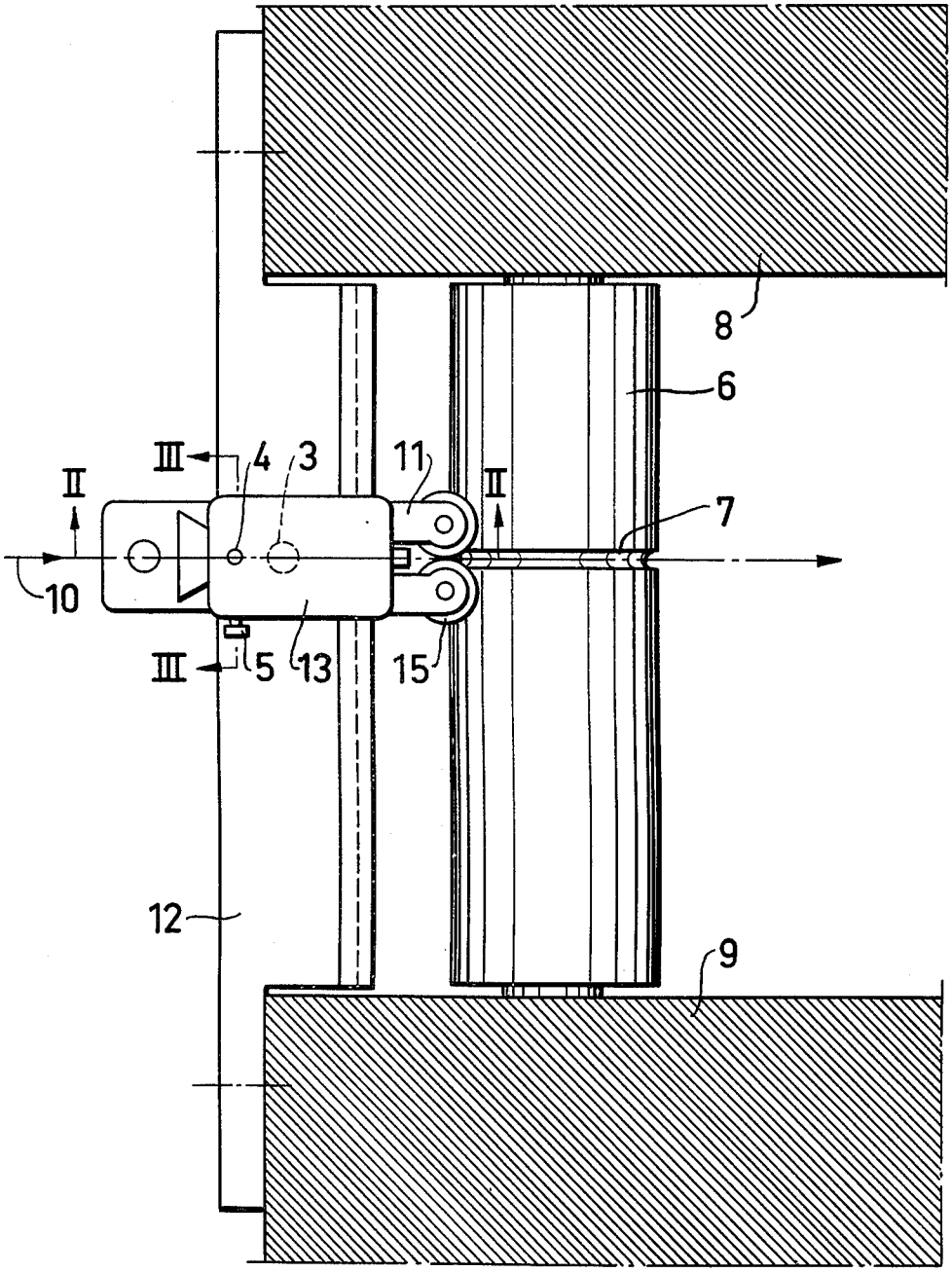
FIG. 1 is a top view of a 2-high rolling stand with the upper roll and the upper portion of the roll stand removed.

Referring to FIG. 1, there is illustrated a top view of a horizontal 2-high rolling stand with its upper roll and the upper portion of the stand removed. A 2-high rolling stand typically includes a pair of rolls, such as 6 in FIG. 1, which are rotatably supported in bearing housings 8 and 9 and between which the rod or wire stock is guided by a roller guide 11. Rolls 6 are provided with grooves 7 between which the stock to be rolled is introduced. It is important that the stock be guided accurately into the grooves 7 and for this purpose the roller guide 11 is provided.

The roller guide 11 includes a guide housing 13, which includes a support portion 1 fixedly attached thereto. Guide housing 13 includes a pair of guide rollers 15 supported for rotation about a pair of parallel axes. Rod of wire stock entering the roller guide through a guide funnel 14 is engaged between the guide rollers 15 and directed between the rolls 6.

The roller guide 11 also includes a base portion 2 which is movable along a rest bar 12 and which supports the guide housing 13. As may readily be appreciated by reference to FIGS. 1 and 2, the lower part of base portion 2 has a dovetail shape and engages a suitable correspondingly shaped portion on the rest bar 12 and serves to guide the roller guide in directions transverse to the path of travel of the wire stock to the roller guide (the direction of stock movement is represented by the numeral 10 in FIG. 1). Movement of the base 2 along the rest bar 12 results in a coarse adjustment of the position of the roller guide 11, as is known.

Figure 2:
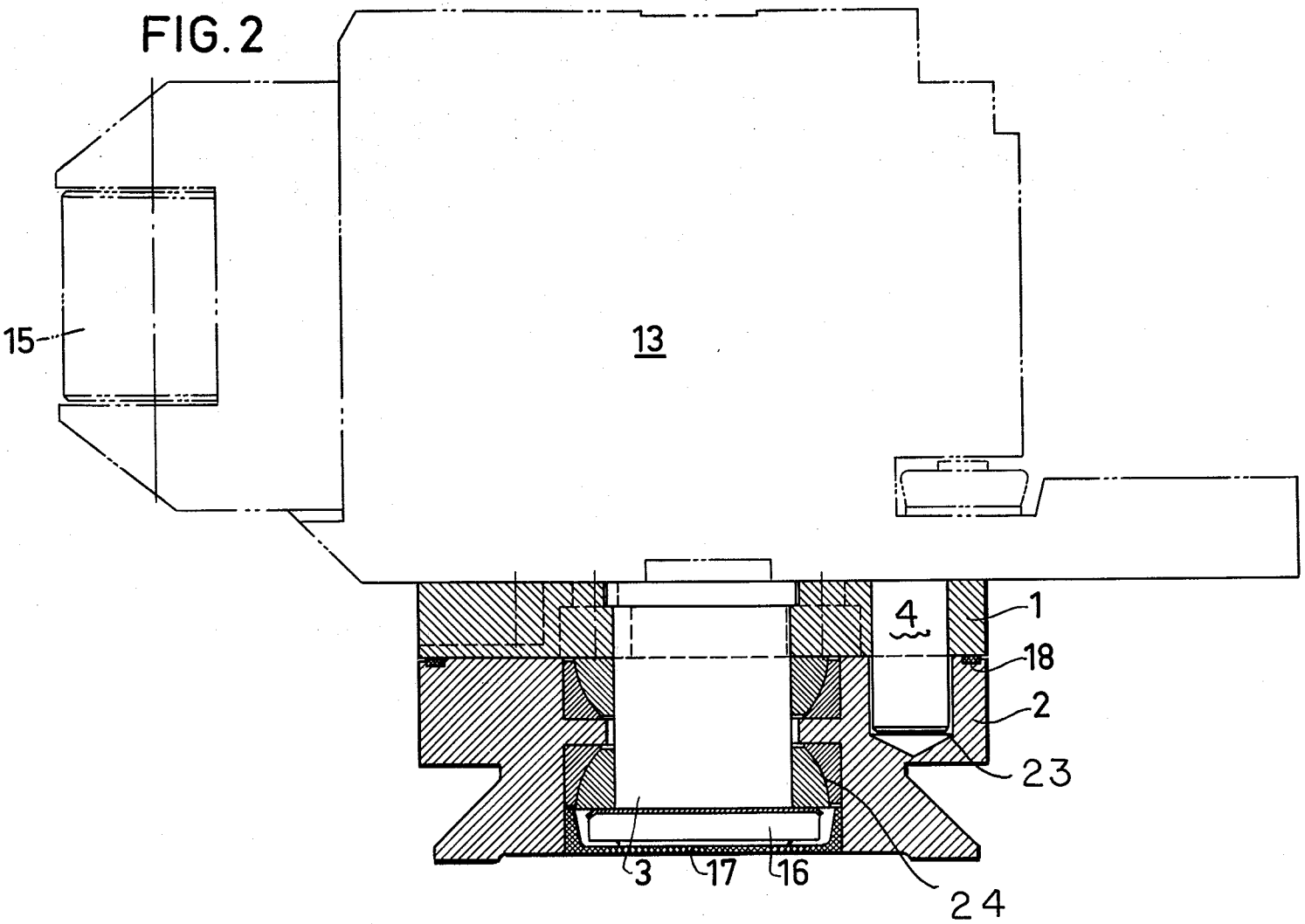
FIG. 2 is a sectional view taken substantially along the line 2—2 in FIG. 1.

Referring now to FIG. 2, the base portion 2 includes an axle 3 which is preferably mounted in the center of the base 2. Axle 3 is supported by a bearing unit which, in the embodiment of FIG. 2, is disclosed as a ball and socket joint 24. Axle 3 projects above base portion 2 and includes an upper extension 25 received in a corresponding bore in guide housing 13.

While a ball and socket joint has been disclosed as the preferred form of bearing support, it is contemplated that the bearing support could be a tapered roller bearing. With either form of bearing support the guide housing 13, as well as the support member 1 attached thereto, are rotatable about the axle 3.

The wire or rod stock which is guided by the roller guide between the rolls may, on occasion, subject the roller guide to excessive vertically oriented loads. The roller guide in accordance with the present invention is adapted to reduce the likelihood of such vertical loads upsetting any of its parts. To achieve this purpose, suitable shims, washers and similar thrust bearing members are provided to fill any gaps in the bearing unit or any spaces between the bearing and the housing portion 1, and a nut 16 threaded on the axle 3 is tightened to prestress the bearing unit. Such prestressing reduces the likelihood of vertical loads upsetting any of the parts of the roller guide. The bearing unit of FIG. 2 is sealed against moisture and dirt by a sealing cover 17, and a sealing ring 18 between the base portions 1 and 2.

Figure 3:
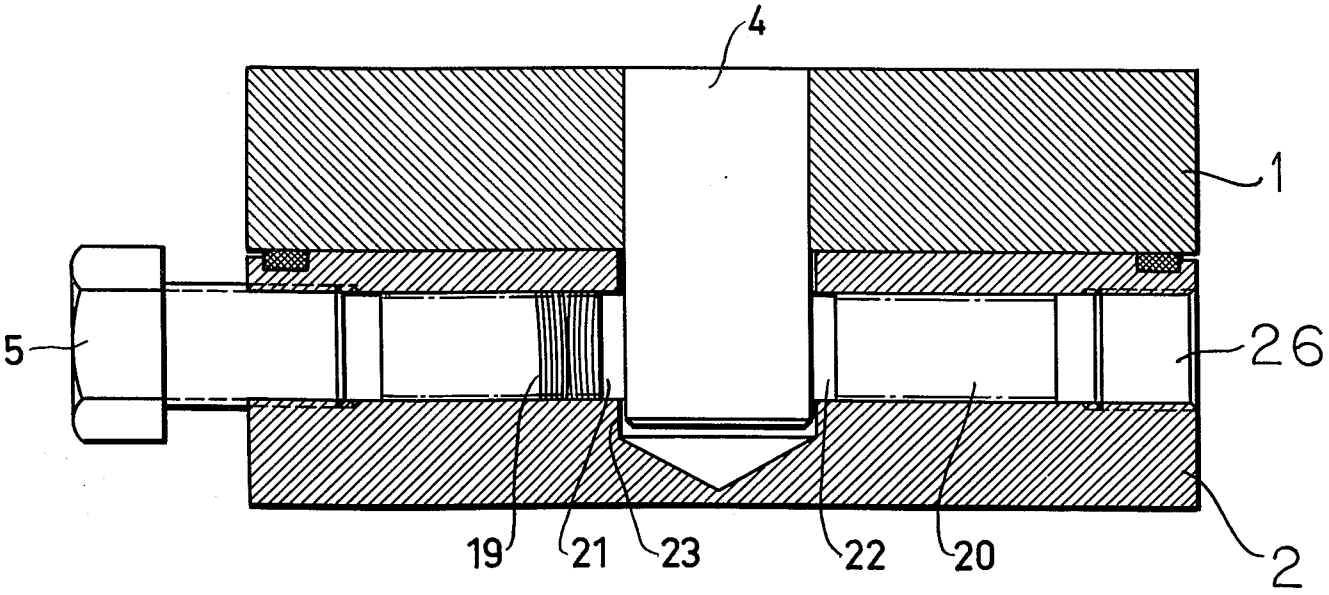
FIG. 3 is a sectional view taken substantially along the line 3—3 of FIG. 1 with certain portions omitted.

Fixedly attached to the guide housing 13 and extending outwardly of support member 1 is a pin member 4, preferably formed as a pin 4 in the embodiments of FIGS. 1 through 3. As may be readily seen from FIGS.

2 and 3, the pin 4 is received in a bore 23 in base portion 2, and the bore 23 has a cross sectional diameter slightly larger than that of the pin 4.

Also provided in the base portion 2 are a pair of chambers or grooves 21 and 22 which extend perpendicular to the axis of rotation of the guide housing 13. In a horizontal 2-high rolling stand the grooves or chambers 21 and 22 extend horizontally. Further, as may be readily appreciated by reference to FIG. 3, the pin 4 may extend into base portion 2 to a point where the entire cross sectional dimension of chambers 21 and 22 are exposed thereto. A set screw 5 engages a threaded portion of the chamber 21 and by movement in the chamber is adapted to apply and regulate a force for effecting fine adjustment of the guide rollers. In FIG. 3 the outer end of the chamber 22 could also include an adjustment screw, similar to 5 although this chamber could also be provided with a stop member such as 26, if desired.

Resilient means, preferably in the form of spring washers 19, 20, are provided in chambers 21 and 22 and are located between the innermost end of the set screws 5 and the pin 4. Of course, if the chamber 21 simply includes a limiting block such as 26 the spring washer 20 would, of course, fill the space between block 26 and pin 4. With this arrangement compressive forces may be applied to the pin 4 by the screwing in of the set screw within the chamber 21. When such compressive forces are introduced, the pin 4 in the slightly wider hole 23 changes its position, and thereby changes the position of the roller guide housing 13 relative to the lower base portion 2. All of the aforesaid described movement takes place about the axle 3. In the fine adjustment of the roller guide the setting of the set screw 5 aligns the roller guide in a desired position, and sets an equilibrium position for the chambers 21 and 22. In this equilibrium position the spring washers, which are under compression, are effective to prestress the set screw, which reduces the likelihood of backlash within the system. Proper alignment of the roller guide is preferably facilitated through the use of an optical setting instrument, which is known for roller guides of this type.

With equilibrium position set by the adjustment of the set screw, the roller guide of the present invention is free to respond to any uneven loading of any of the rollers in such a manner that both rollers move together and maintain their preloaded grip on the rod stock. Since the prestressing of the roller guide by the nut 16 is accomplished in a direction perpendicular to the axis of rotation of the guide housing 13 this does not unduly impede fine adjustment of the base about the axle 3.

In operation, when the rod or stock temporarily does not follow a correct path through the roller guide, both rollers participate to correct for the deviation, and upon termination of the deviation the roller may assume its fine adjustment position as soon as the balance in the chambers 21 and 22 is restored.

Having described the invention, what is claimed is:

1. A roller guide for guiding rod or wire stock between a pair of rolls which shape the stock, said roller guide comprising a pair of guide rollers which engage opposite surface portions of the stock, a guide housing on which said guide rollers are mounted, means for supporting said guide rollers on said guide housing for rotation about parallel axes, a base on which said guide housing is mounted, and fine adjustment means for effecting a fine adjustment of the position of the guide housing relative to said base to effect a fine adjustment of the guide rollers, said fine adjustment means comprising a member fixedly carried by said guide housing, a movable adjustment member and resilient means interposed between said movable adjustment member and said member and which yields to enable movement of said guide housing and both of said rollers to occur in response to forces applied to said rollers.

2. A roller guide as set forth in claim 1 wherein said guide housing is mounted for rotational movement relative to said base, and said fine adjustment means is adapted to apply a force to said member which is directed perpendicular to the axis of rotation of said guide housing, whereby movement of said movable adjustment member is adapted to apply a torque to said guide housing tending to rotate said guide housing about said axis.

3. A roller guide as set forth in claim 2 wherein said adjustment member comprises a set screw and said resilient means includes one or more spring washers between said set screw and said member.

4. A roller guide as set forth in claim 3 wherein said member comprises a pin being fixedly supported by said guide housing and extending outwardly therefrom, said base including a hole having a cross sectional dimension which is greater than the cross sectional dimension of said pin.

5. A roller guide as set forth in claim 4 wherein said guide housing is rotatably mounted on said base in an axially prestressed bearing.

6. A roller guide as set forth in claim 5 wherein said bearing comprises a ball and socket joint.

7. A roller guide as set forth in claim 5 further including means for sealing said bearing to protect the same against moisture or other ambient conditions.

8. A roller guide for guiding rod or wire stock between a pair of rolling members, comprising a guide housing, means for rotatably supporting a pair or guide rollers on said guide housing for rotation about parallel axes, means for pivotally supporting said guide housing about an axis which is substantially parallel to the axis of said guide rollers and which axis extends transverse to the direction of stock movement, and means for rotating said guide housing about said axis for adjusting the position of said guide rollers relative to the rolling members.

9. A roller guide as set forth in claim 8 wherein said means for rotating said guide housing comprises means for applying a force to said guide housing, said force being applied in a plane which is perpendicular to the axis of said guide rollers and perpendicular to the axis of rotation of said guide housing.

* * * * *